US007320343B2

(12) United States Patent
Speich

(10) Patent No.: US 7,320,343 B2
(45) Date of Patent: Jan. 22, 2008

(54) LOOM

(75) Inventor: Francisco Speich, Gipf-Oberfrick (CH)

(73) Assignee: Textilma AG (CH)

( * ) Notice: Subject to any disclaimer, the term of this patent is extended or adjusted under 35 U.S.C. 154(b) by 186 days.

(21) Appl. No.: 10/559,948

(22) PCT Filed: Jun. 3, 2004

(86) PCT No.: PCT/CH2004/000337

§ 371 (c)(1),
(2), (4) Date: Dec. 8, 2005

(87) PCT Pub. No.: WO2004/111321

PCT Pub. Date: Dec. 23, 2004

(65) Prior Publication Data

US 2006/0169345 A1 Aug. 3, 2006

(30) Foreign Application Priority Data

Jun. 12, 2003 (CH) ..... 1027/03

(51) Int. Cl.
*D03D 49/22* (2006.01)
*D03D 49/04* (2006.01)
*D03D 49/12* (2006.01)
*D03C 13/00* (2006.01)

(52) U.S. Cl. ..... 139/55.1; 139/35; 139/110; 139/114; 139/97

(58) Field of Classification Search ..... 139/55.1, 139/35, 5, 48, 110, 114, 97
See application file for complete search history.

(56) References Cited

U.S. PATENT DOCUMENTS 3,103,953 A * 9/1963 Lauritsen ..... 139/455
3,240,235 A * 3/1966 Burgess ..... 139/25
4,515,186 A * 5/1985 Durville et al. ..... 139/455
4,682,634 A * 7/1987 Palau et al. ..... 139/85
4,739,806 A * 4/1988 Palau et al. ..... 139/455
5,305,802 A * 4/1994 Fehrenbach ..... 139/103
5,363,884 A * 11/1994 Migliorini et al. ..... 139/455

(Continued)

FOREIGN PATENT DOCUMENTS

DE 10 24 897 3/1953

(Continued)

*Primary Examiner*—Gary L. Welch
*Assistant Examiner*—Robert H Muromoto, Jr.
(74) *Attorney, Agent, or Firm*—George Pappas

(57) ABSTRACT

The invention relates to a loom comprising a warp thread tensioning device and a shedding device (12), which comprises pre-tensioned warp threads (4) in a first shedding position ($F_1$). The loom also comprises a lifting device (38), which can be driven in an oscillating manner, and followers (40) for the warp threads (4), in addition to control means (46) that can be operated by actuators (44) in order to selectively engage the warp threads (4) in the followers (40) and that displace the warp threads (4) into a second shedding position ($F_3$). To simplify said loom, a second lifting device (48), which is common to all warp threads (4), is provided in order to displace said warp threads (4) from the first shedding position ($F_1$) into a selection position ($F_2$), in which the first lifting device (38) is active, and in order to displace non-selected warp threads in unison into the first shedding position ($F_1$) by the pre-tensioning of said warp threads (4).

21 Claims, 6 Drawing Sheets

U.S. PATENT DOCUMENTS 5,628,347 A * 5/1997 Rush ..... 139/455
5,669,248 A * 9/1997 Mista et al. ..... 66/205
5,890,519 A * 4/1999 De Jager et al. ..... 139/110
6,041,831 A * 3/2000 Kuoni et al. ..... 139/55.1
6,328,076 B1 * 12/2001 Speich ..... 139/55.1
2006/0169345 A1 * 8/2006 Speich ..... 139/55.1

FOREIGN PATENT DOCUMENTS

WO WO 99/13145 3/1997
WO WO 97/11215 3/1999

* cited by examiner

LOOM

This application claims priority of PCT application PCT/CH2004/000337 having a priority date of Jun. 12, 2003, the disclosure of which is hereby incorporated herein by reference.

FIELD OF THE INVENTION

The invention relates to a loom.

BACKGROUND OF THE INVENTION

A loom of the type initially mentioned is known from WO 99/13145. The loom contains a warp thread tensioning device and a shedding device which has warp threads pretensioned into a first shedding position. A lifting device capable of being driven in oscillation is equipped with drivers for the warp threads, there being control means actuable by means of actuators, in order to bring the warp threads selectively into engagement with the drivers which move the warp threads into a second shedding position. There is the disadvantage that, in this loom, the lifting device equipped with the drivers has to move along the entire travel of the warp threads from the first shedding position as far as the second shedding position. The lifting device therefore has to execute a relatively long travel, which, on the one hand, is time-consuming and, on the other hand, requires higher drive forces. In order to avoid this, in WO 99/13145 there is a further exemplary embodiment, in which the warp threads assume a middle shedding position and there are two lifting devices which each have drivers in order to move the warp threads either into the top shedding position or into the bottom shedding position. This requires double the number of drivers, with the result that such a design variant is highly complicated and consequently cost-intensive.

SUMMARY OF THE INVENTION

The object of the invention is to improve a loom of the type initially mentioned.

The set object is achieved by means of the characterizing features of claim 1. Since the loom has a second lifting device which is common to all the warp threads and which moves the warp threads out of the first shedding position into a switching position effective for the first lifting device, this results, for all the warp threads, in a very simple second lifting device which, moreover, appreciably reduces the switching travel for the first lifting device, so that the first lifting device has to move a warp thread only out of the switching position into the second shedding position. Both lifting devices have to execute only a limited travel for which they require less time.

Moreover, since the lifting devices can be active simultaneously, an appreciable increase in the performance of the loom is obtained. In addition, owing to this design, the useful life is also improved owing to the lower susceptibility to wear. The loom also results in lower noise emission. Advantageous refinements of the loom are described below.

The second lifting device may be a lifting beam extending over all the warp threads. The lifting travel of the second lifting device may vary greatly, and it is advantageous if, the latter executes at least half the lifting travel of the warp threads in the shed.

For the design of the first lifting device, there are various design variants which are already contained in WO 99/13145. An embodiment that is particularly advantageous, includes a first lifting device which has for each warp thread a control drop wire with a driver slot and an assigned driver, preferably of hook-shaped design, for the associated warp thread. The warp thread can be brought selectively into engagement with the driver by means of a control drop wire switchable by means of the actuator. In some embodiments, the driver slot is assigned to the displacement path of the driver and, in the switching region, is guided, via a control slot running obliquely with respect to the direction of displacement of the driver, out of the displacement path of the driver into a widened guide slot of the control drop wire. To facilitate the introduction of the warp thread into the control slot, the guide slot is provided with a run-on side.

In principle, the control drop wire may be configured as a sheet steel strip. In one advantageous design, the control drop wire is formed in the shape of a sleeve with two side walls, between which the driver is mounted displaceably. A reliable guidance of the warp thread from and to the driver is thereby achieved. To protect the warp thread, on the one hand, and to facilitate the run of the warp thread through the control drop wire, on the other hand, at least the guide slot and the control slot are offset relative to one another in the two side walls of the control drop wire in the direction of run of the warp thread, in such a way that a deflection of the running warp thread in the control drop wire is lower than 90°, preferably 10°.

There are various possibilities for driving the drivers, there being preference, for all the drivers of a row to be movable up and down by means of a common lifting knife. This affords a particularly simple and cost-effective solution.

Since the warp threads are moved in each case out of a first shedding position into the second shedding position, their displacement travel is such that the elasticity of the warp thread is not sufficient, as a rule, to ensure satisfactory functioning. It is therefore advantageous if, the warp thread tensioning device has an individual thread tensioner for each warp thread on the run-in side of the warp threads to the shedding device. The tension of the individual warp thread can thereby be adapted more closely to the respective position of the warp thread in the shed. The loom may have the conventional additional catch thread devices. It is more advantageous, however, if, the thread tensioner is at the same time also designed as a catch thread device.

In some embodiments, each warp thread is guided via two guide elements which are arranged at a distance from one another and between which is arranged the thread tensioner which engages on the warp thread and exerts a pretension on the warp thread. The pretension may be generated by a tensioning weight. In a more advantageous design, the pretension is generated by a tensioning spring. This also makes it possible, in particular, to arrange the thread tensioner in a position deviating from the vertical.

The thread tensioner may be provided with a closed eye. In a more advantageous design however, each thread tensioner has a lateral run-in eye for the warp thread. In some embodiments, each thread tensioner is provided with a guide orifice, by means of which it is mounted on a holder displaceably in the tensioning direction. Expediently, the thread tensioner is provided, in the direction opposite to the pretensioning direction, with a grip part which preferably has a signal part projecting out of the direction of displacement. Such a signal part may be, for example, a projecting head part of the thread tensioner. As a result, a thread tensioner on which a thread fault has occurred can be detected more easily, since it emerges from the plane of the thread tensioners which are operating satisfactorily.

It is particularly expedient if, the thread tensioner is arranged on a holder which has a middle contact part which projects on one side and which, insulated, is embedded into lateral contact parts cooperating with the sides of the guide orifice of the thread tensioner. In the event of a faulty warp thread tension, the contact parts come into touch with an end face of the guide orifice, this touch bridging the contacts and thus triggering a fault signal.

The thread tensioner can be used in the most diverse possible looms. It is preferably used, however, in a loom in which the warp thread tensioning device has a control device which is connected to the drive of a cloth take-up in such a way as to control the warp beam such that the warp threads as a whole are under a predeterminable tension force. The retaining force may be generated by means of a braking device at the warp let-off. To generate the retaining force in a more advantageous embodiment, the warp beam is provided with specific drive which contains a selflocking gear. The warp thread tensioning device can be further improved by means of the design, according to which it has a back bearer for the warp threads which is pretensioned by means of a tensioning spring device. The tensioning spring device is connected to the control device, so that the drives of the warp beam and of the cloth take-up can be controlled in such a way that the predeterminable tension force is maintained at the back bearer. Various variants may be envisaged for the design of the tensioning spring device. In a particularly advantageous embodiment, the tensioning spring device has a leaf spring with a flexion converter which delivers corresponding control signals to the control device. In addition, the warp thread tensioning device may be designed with a safety device which is operatively connected to the back bearer and which contains an emergency switch which responds when the force of the warp threads which occurs in the back bearer is greater than the set tension force by a determinable safety amount.

BRIEF DESCRIPTION OF THE DRAWINGS

Exemplary embodiments of the invention are described in more detail below with reference to the drawings in which.

DETAILED DESCRIPTION OF THE INVENTION

Figure 1:
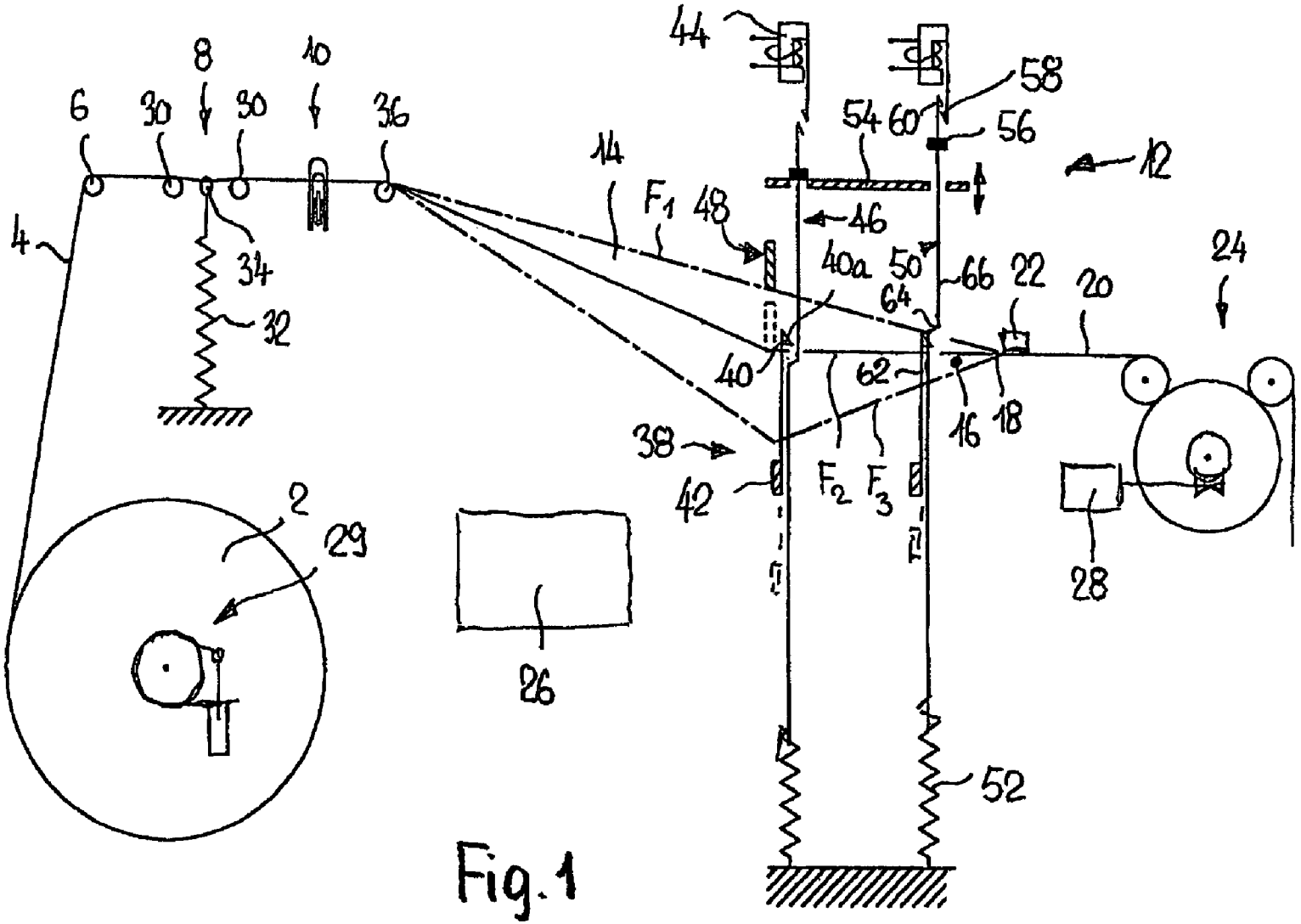
FIG. 1 shows a diagram of a loom in a side view.

FIG. 1 shows diagrammatically a loom which, in general, has a warp let-off 2 which is designed, for example, as a warp beam, from which warp threads 4 arrive at the shedding device 12 via a back bearer 6, individual thread tensioners 8 and catch thread devices 10. In the shedding device 12, the warp threads 4 are opened to form a shed 14 into which can then be introduced a weft thread 16 which is beaten up at the beating-up edge 18, so that a cloth web 20 is obtained. The cloth web 20, held by a cloth holder 22, is taken up via a cloth take-up 24. A control device 26 serves for controlling the loom.

The loom is provided with a thread tensioning device which primarily contains the cloth take-up 24, the drive 28 of which is controlled by means of the control device 26 such that a predeterminable tension force common to all the warp threads 4 is given as a function of the retaining force of the warp let-off 2. The retaining force of the warp let-off may be generated by means of a braking device 29 or a specific drive, in which a motor is connected to the warp let-off via a selflocking gear. The warp thread tensioning device additionally contains, for each warp thread 4, an individual warp thread tensioner 8 which is arranged between two guide elements 30 and, in the example shown, individually pretensions, by means of a pretensioning spring 32, the warp thread 4 which runs through an eye 34.

In the shedding device 12, the warp threads 4 are pretensioned into a first shedding position $F_1$ between a deflecting roller 36 and a cloth holder 22 which may also be designed as an expander. A first lifting device 38 serves for the individual control of the warp threads 4, said lifting device having drivers 40 which can be moved out of a switching position $F_2$ into the second shedding position $F_3$ by means of a lifting beam 42. With the aid of control means 46 controllable by actuators 44, the warp threads 4 can be brought selectively into engagement with the drivers 40 when the warp threads have been moved out of the first shedding position $F_1$ into the switching position $F_2$ by means of a common second lifting device 48, as is evident in detail in FIGS. 1 to 8. The control means 46 contain control drop wires 50 which are pretensioned by means of a pretensioning spring 52 against a lifting beam 54 on which they stand via a stop 56. The actuators 44 contain hook parts 58 which cooperate with hook parts 60 on the control drop wires 50 and, in the activated state, hold the control drop wire 50 in the lifted position. A nonactivated actuator 44 enables the displacement travel of the control drop wire 50. In FIG. 1, each control drop wire 50 is symbolized by its switching travel, as illustrated in detail by means of FIGS. 2 to 8. Thus, the control drop wires contain a driver slot 62 which lies in the displacement travel of the warp thread 2. The driver slot has adjoining it upwardly a control slot 64 which guides the warp thread out of the displacement travel of the driver into a widened guide slot 66, so that it can no longer be grasped by the driver 40.

Figure 2:
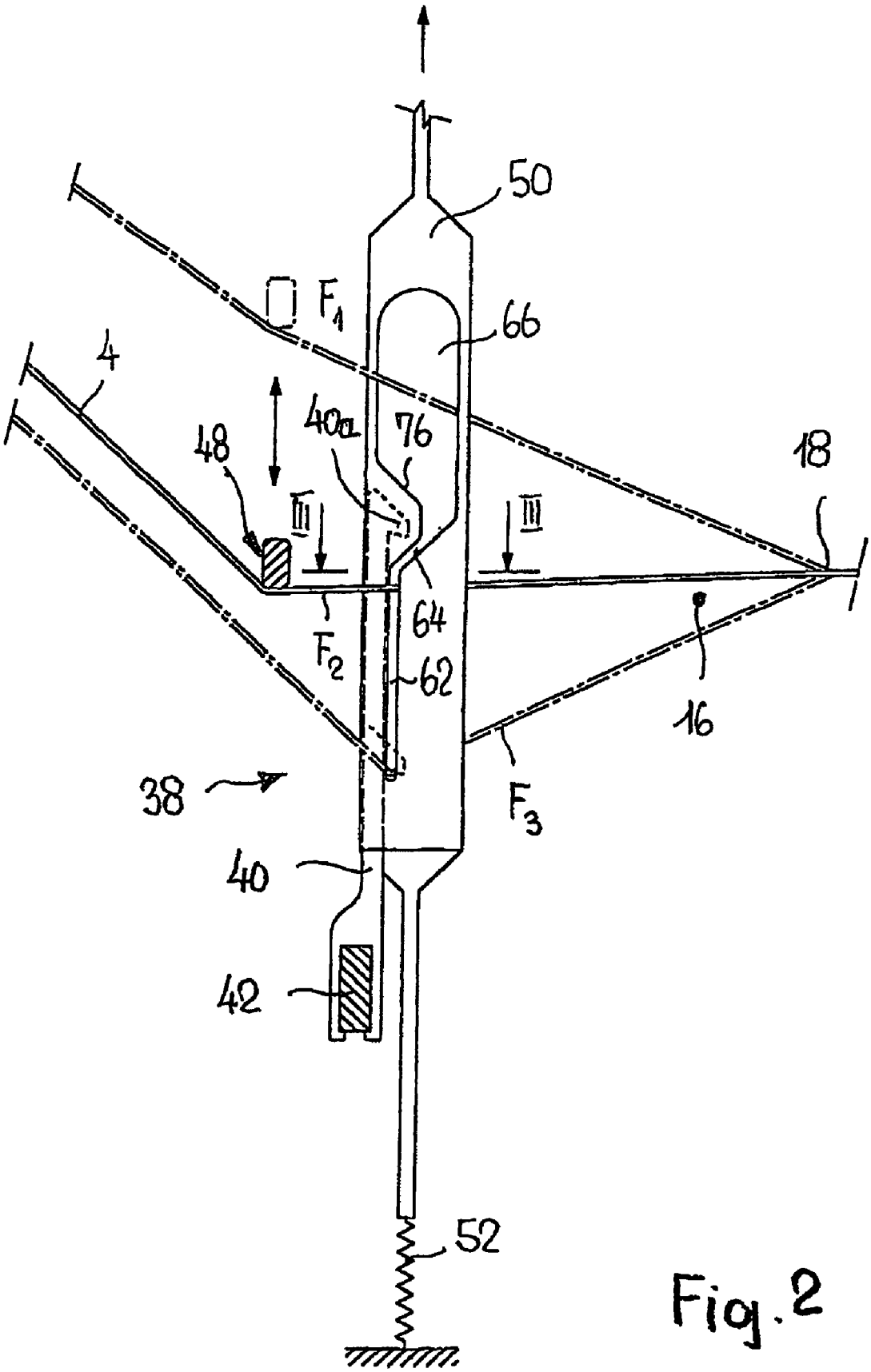
FIG. 2 shows a detail of the shedding device of the loom of FIG. 1 on a larger scale.
Figure 3:
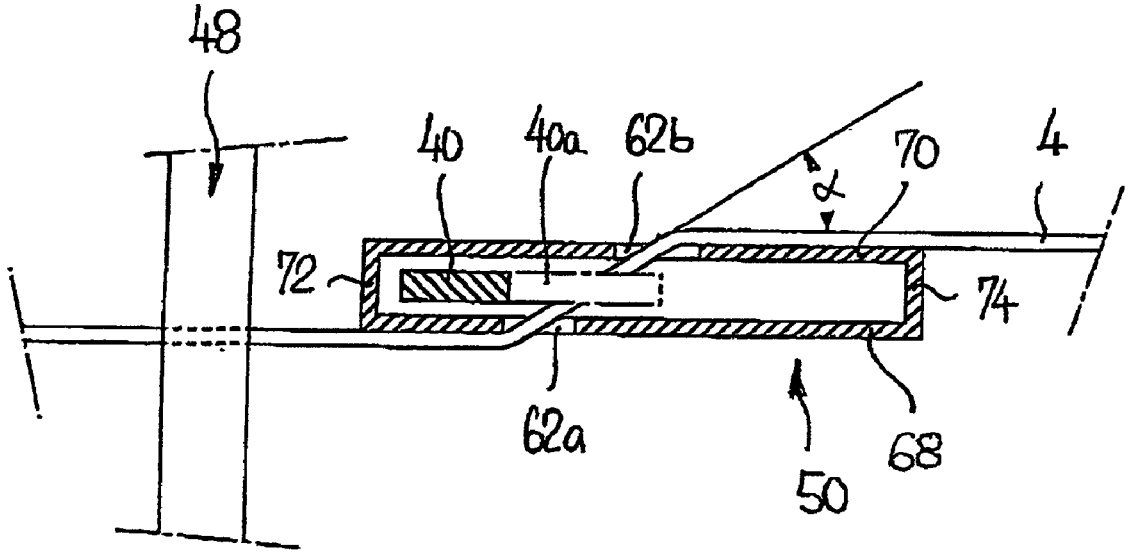
FIG. 3 shows the shedding device of FIG. 2 in the section III-III.
Figures 4, 5, 6, 7, 8:
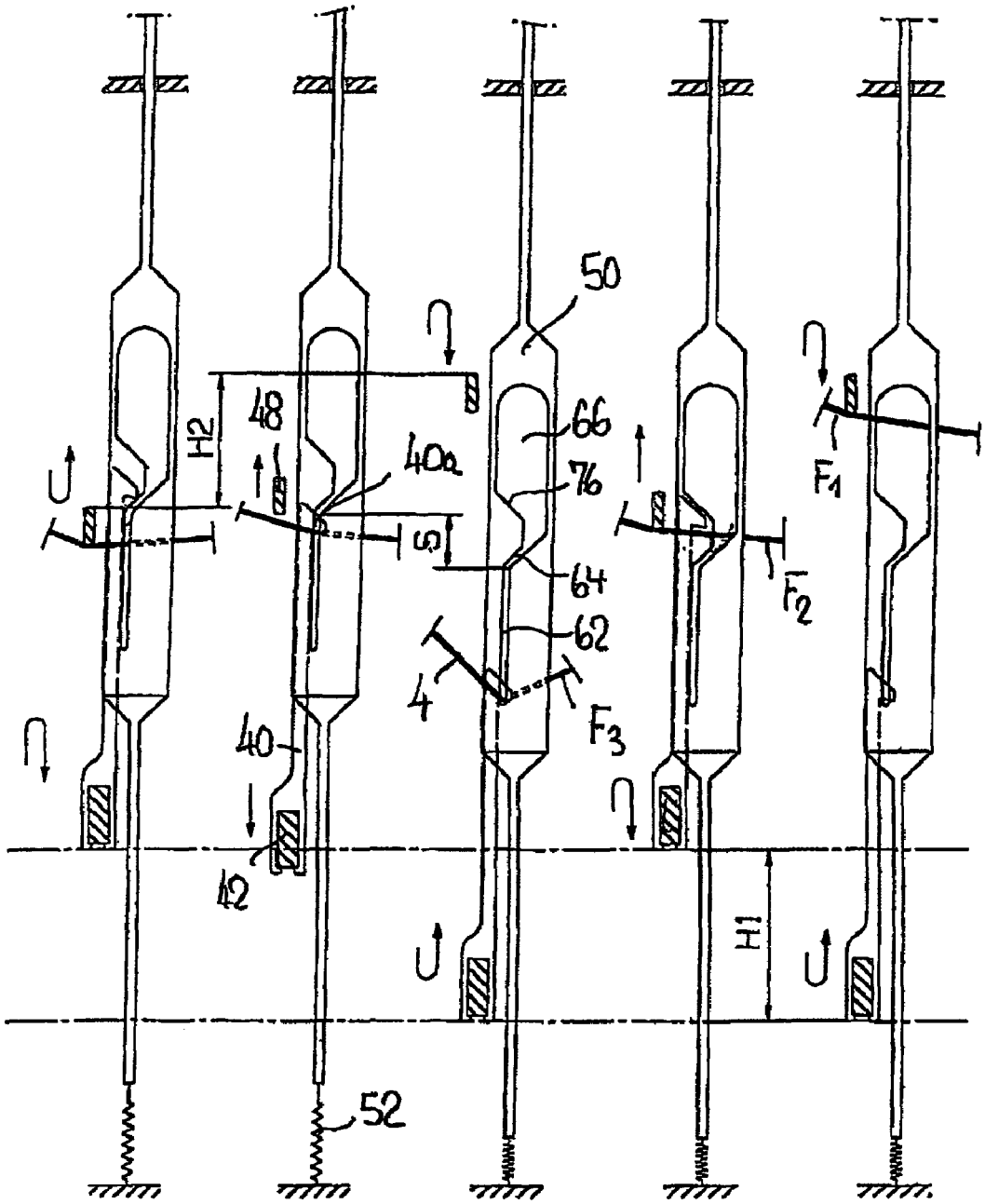
FIGS. 4-8 show various work stages of the shedding device of FIG. 2.

As may be gathered from FIGS. 2 and 3, the control drop wire is designed in the form of a sleeve and has side walls 68, 70 which are connected by means of end walls 72, 74 and which thus provide a cavity in which the driver 40 is mounted displaceably. In particular, the driver slots 62*a* and 62*b* are arranged in the side walls 68, 70 so as to be offset in the direction of run of the thread in such a way that the warp thread, when it passes through the control drop wire, is inclined at an angle $\alpha$ from the vertical with respect to the control drop wire which is smaller than 90°, preferably 40°, in order to keep as low as possible the passage resistance of the warp thread through the control drop wire and consequently the wear of the warp thread, on the one hand, and of the control drop wire, on the other hand.

The functioning of the shedding device is illustrated in more detail with reference to FIG. 1 in conjunction with FIGS. 2 to 8. When the control drop wire is in the lifted position, in which it is retained on the actuator, as may be gathered from FIG. 1 for the actuator on the right and from FIGS. 2, 4 and 5, the warp thread is guided by means of the second lifting device 40 out of the guide slot 66 via an oblique run-on side 76 into the control slot 64 and by means of the latter into the driver slot 62 in which the warp thread lies in the displacement travel of the driver 40. During the downward movement of the driver 40, the warp thread 4 is driven by the hook 40*a* of the driver 40 out of the switching position $F_2$ into the second shedding position $F_3$ which is the bottom shedding position. As long as the control drop wire 50 remains in the lifted state, the warp thread 4 is moved to and fro by the amount of the height H1 only between the switching position $F_2$ and the bottom shedding position $F_3$, as is evident from FIGS. 2 and 4 to 6.

As soon as the actuator 44 releases the control drop wire 50 and the latter is lowered by the amount of the switching quantity S, during the upward movement of the driver 40 the warp thread passes via the control slot 64 into the widened guide slot 66 and consequently outside the displacement travel of the driver 40. Then, as may be gathered from FIGS. 7 and 8, the warp thread passes again into the displacement travel of the second lifting device 48 and is moved over the height H2 out of the switching position into the first shedding position $F_1$ which is the top shedding position.

Figure 9:
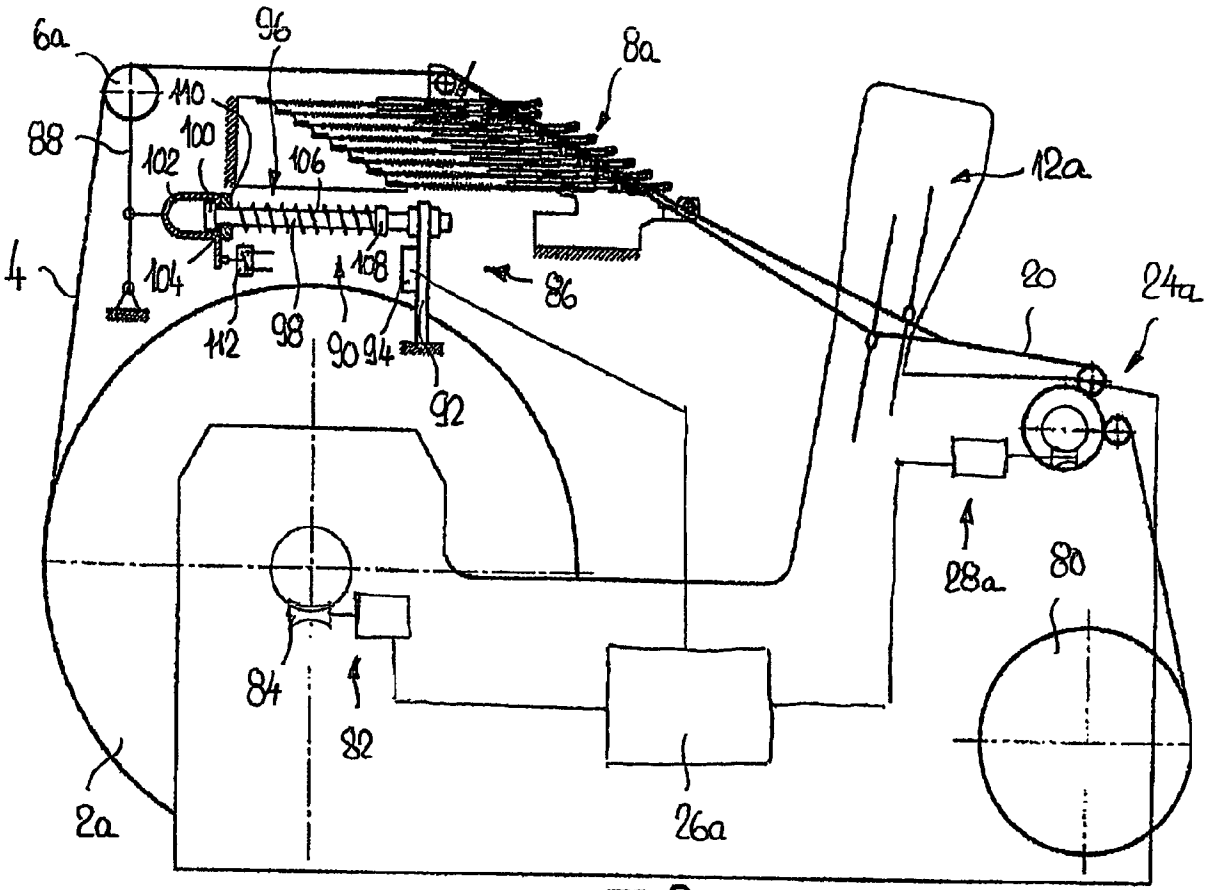
FIG. 9 shows the diagram of a further loom with individual thread tensioners in a side view.

FIG. 9 shows a loom with a special design of the warp thread tensioning device and of the thread tensioners, which loom may have, for example, a shedding device according to the loom of FIG. 1. The loom contains a warp beam 2*a*, from which warp threads 4 are guided via a back bearer 6*a* to individual thread tensioners 8*a* which are arranged upstream of a shedding device 12*a*. The shedding device 12*a* may be designed similarly to the shedding device 12 of the loom of FIG. 1, but may also have other designs. The cloth web 20 produced is taken up via a cloth take-up 24*a* and wound up on a cloth beam 80. The loom contains a control device 26*a* which is designed, in particular, for controlling the warp thread tensioning device. The warp beam 2*a* is actuated by a drive 82 which has a selflocking gear 84. The drive is controlled by the control device 26*a*, specifically as a function of the drive 28*a* of the cloth take-up 24*a* and of a tensioning spring device 86 with which the back bearer 6*a* stands against the warp threads 4. The control is such that the cloth take-up 24*a* is set as a function of the retaining force of the drive 82 of the warp beam 2*a* such that a predetermined tension force can be maintained at the back bearer 6*a*.

The warp beam 6*a* is fastened to a rocker 88 which is supported via a supporting device 90 on a leaf spring 92 provided with a flexion converter 94 which transfers its data to the control device 26*a*. The supporting device 90 comprises a safety device 96 containing a screw bolt 98, the head 100 of which is arranged displaceably in a holding bell 102. The holding bell 102 is connected to the rocker 88. The head 100 is supported on a stop 104 of the holding bell. A pretensioning spring 106 arranged outside the holding bell 102 is supported, on the one hand, on the screw bolt 98 via a setscrew 108 and on the holding bell 102 via a washer 110 on the other hand so that the head 100 bears with a corresponding pretensioning force against the stop 104 of the holding bell 102. The screw bolt 98 is connected, further, to the leaf spring 92. If, then, a tension force higher than the tension force set as permissible on the leaf spring 92 occurs at the back bearer 6*a*, the pretensioning spring 106 is compressed and the holding bell 102 is displaced on the screw bolt 98, with the result that a switch 112 connected to the holding bell 102 is closed and transmits a fault signal to the control device 26*a*.

Figure 11:
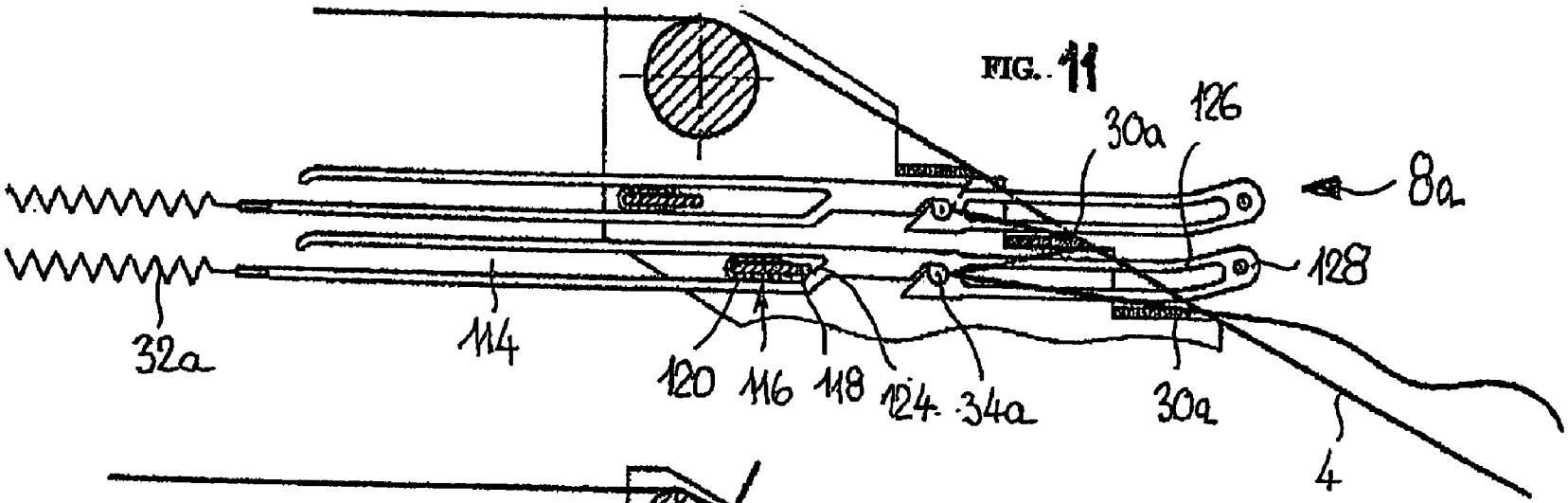
FIG. 11 shows a detail of the device according to FIG. 10.
Figure 10:
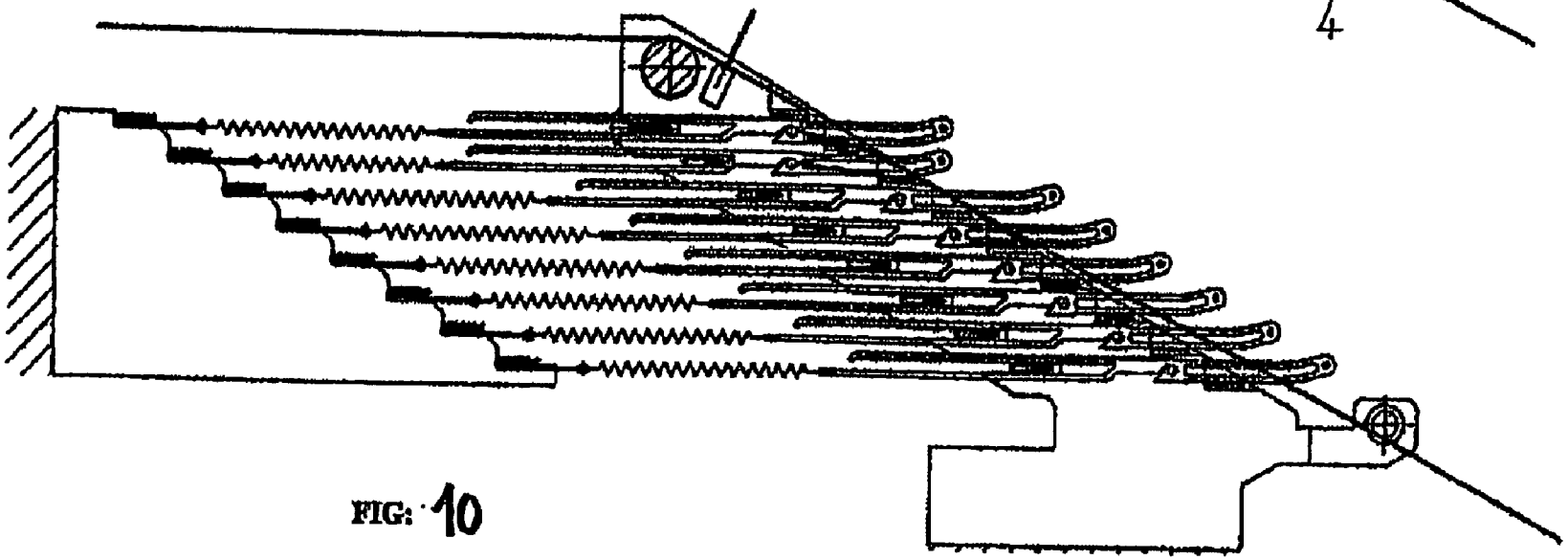
FIG. 10 shows the thread tensioner of the loom according to FIG. 9 on a larger scale.

FIGS. 10 and 11 show in detail the design of the thread tensioners 8*a* which are at the same time also configured as catch thread devices. The thread tensioners 8*a* are designed as drop wires and each have a guide orifice 114, by means of which they are mounted on a holder 116 displaceably in the tensioning direction. The holders have a middle contact part 118 which projects on one side and which, insulated, is embedded into lateral contact parts 120. The latter are connected to the sides of the guide orifice. In the event of a faulty warp tension, the thread tensioners 8*a* are displaced by means of the pretensioning spring 32*a* until the contact parts 118, 120 of the holder 116 stand against an end face 124 of the guide orifice 114 and trigger a fault warning. The thread tensioners lie in each case between two guide elements 30*a* for the warp thread 4 which is pieced up to the thread tensioners 8*a* via run-in eyes 34*a*. On the side facing away from the pretensioning spring 32*a*, the thread tensioners each contain a grip part 126 with a signal part 128 which projects out of the displacement plane of the thread tensioners, so that it is possible to detect those thread tensioners which indicate a broken warp thread and for this reason are no longer in alignment with the remaining signal parts 128. The signal part 128 is formed by a head part projecting out of the displacement plane.

List of reference symbols

| | |
|---|---|
| $F_1$ | First shedding position |
| $F_2$ | Switching position |
| $F_3$ | Second shedding position |
| $H_1$ | Lift height of the 1st lifting device |
| $H_2$ | Lift height of the 2nd lifting device |
| S | Switching quantity |
| α | Deflection |
| 2, 2a | Warp let-off (warp beam) |
| 4 | Warp thread |
| 6, 6a | Back bearer |
| 8, 8a | Thread tensioner |
| 10 | Catch thread device |
| 12, 12a | Shedding device |
| 14 | Shed |
| 16 | Weft thread |
| 18 | Beating-up edge |
| 20 | Cloth web |
| 22 | Cloth holder |
| 24, 24a | Cloth take-up |
| 26, 26a | Control device |
| 28, 28a | Drive |
| 29 | Braking device |
| 30, 30a | Guide element |
| 32, 32a | Pretensioning spring |
| 34, 34a | Eye |
| 36 | Deflecting roller |
| 38 | First lifting device |
| 40 | Driver |
| 40a | Hook |
| 42 | Lifting beam |
| 44 | Actuator |
| 46 | Control means |
| 48 | Second lifting device |
| 50 | Control drop wire |
| 52 | Pretensioning spring |
| 54 | Lifting beam |
| 56 | Stop |
| 58 | Hook part of 44 |
| 60 | Hook part of 50 |
| 62 | Driver slot |
| 62a | Driver slot |
| 62b | Driver slot |
| 64 | Control slot |
| 66 | Guide slot |
| 68 | Side wall |
| 70 | Side wall |
| 72 | End wall |
| 74 | End wall |
| 76 | Run-on side |
| 80 | Cloth beam |
| 82 | Drive |

-continued

| List of reference symbols | |
|---|---|
| 84 | Selflocking gear |
| 86 | Tensioning spring device |
| 88 | Rocker |
| 90 | Supporting device |
| 92 | Leaf spring |
| 94 | Flexion converter |
| 96 | Safety device |
| 98 | Screw bolt |
| 100 | Head |
| 102 | Holding bell |
| 104 | Stop |
| 106 | Pretensioning spring |
| 108 | Setscrew |
| 110 | Washer |
| 112 | Switch |
| 114 | Guide orifice |
| 116 | Holder |
| 118 | Contact part |
| 120 | Lateral contact parts |
| 124 | End face |
| 126 | Grip part |
| 128 | Signal part |

What is claimed is:

1. A loom with a warp thread tensioning device and with a shedding device which has warp threads pretensioned into a first shedding position, furthermore with a lifting device capable of being driven in oscillation and having drivers for the warp threads, and also with control means actuable by means of actuators, in order to bring the warp threads, and also with control means actuable by means of actuators, in order to bring the warp threads selectively into engagement with the drivers which move the warp threads into a second shedding position, wherein said loom has a second lifting device designed as a lifting beam common to all the warp threads, in order to move the warp threads out of the first shedding position into a switching position active for the first lifting device and in order to move nonselected warp threads jointly into the first shedding position as a result of the pretensioning of the warp threads.

2. The loom as claimed in claim 1, characterized in that the second lifting device executes at least half of the lifting travel of the warp threads in the shed.

3. The loom as claimed in one of claims 1, characterized in that the first lifting device has, for each warp thread, a control drop wire with a driver slot and an assigned driver, preferably of hook-shaped design, for the associated warp thread, the warp thread being capable of being brought selectively into engagement with the driver by means of the control drop wire switchable by means of the actuator.

4. The loom as claimed in claim 3, characterized in that the driver slot is assigned to the displacement path of the driver and, in the switching region, leads, via a control slot running obliquely with respect to the direction of displacement of the driver, out of the displacement path of the driver into a widened guide slot of the control drop wire.

5. The loom as claimed in claim 4, characterized in that the guide slot has a run-on side running toward the control slot.

6. The loom as claimed in one of claim 3, characterized in that the control drop wire is designed in the form of a sleeve with two side walls, the driver being mounted displaceably between the side walls.

7. The loom as claimed in claim 6, characterized in that at least the driver slot and the control slot are formed in the two side walls, the driver slots and the control slots of the side walls being offset relative to one another in the direction of run of the warp thread in such a way that a deflection of the running warp thread in the control drop wire is lower than 90°, preferably 10°.

8. The loom as claimed in one of claim 3, characterized in that all the drivers of a row can be moved up and down by means of a common lifting beam.

9. The loom as claimed in one of claim 1, characterized in that the warp thread tensioning device has an individual thread tensioner for each warp thread on the run-in side of the warp threads to the shedding device.

10. The loom as claimed in claim 9, characterized in that the thread tensioner is designed as a catch thread device.

11. The loom as claimed in claim 9, characterized in that each warp thread is guided via two guide elements which are arranged at a distance from one another and between which is arranged the thread tensioner which engages on the warp thread and exerts a pretension on the warp thread.

12. The loom as claimed in claim 11, characterized in that the pretension is generated by a tensioning weight.

13. The loom as claimed in claim 11, characterized in that the pretension is generated by a tensioning spring.

14. The loom as claimed in one of claim 9, characterized in that each thread tensioner as a lateral run-in eye for the warp thread.

15. The loom as claimed in one of claim 9, characterized in that each thread tensioner has a guide orifice, by means of which it is mounted on a holder displaceably in the tensioning direction, the thread tensioner having, in the direction opposite to the pretensioning direction, a grip part which is provided with a signal part projecting out of the displacement direction.

16. The loom as claimed in claim 15, characterized in that the holder has a middle contact part which projects from one side and which, insulated, is embedded into lateral contact parts cooperating with the sides of the guide orifice of the thread tensioner, and, in the event of a faulty warp thread tension, the contact parts can be bridged by means of an end face of the guide orifice for fault warning.

17. The loom as claimed in one of claim 1, characterized in that the warp thread tensioning device has a control device which is connected to the drive of a cloth take-up, in order to control the drive of the cloth take-up as a function of the retaining force of a warp beam, in such a way that the warp threads as a whole are under a predeterminable tension force.

18. The loom as claimed in claim 17, characterized in that, to generate the retaining force, the warp beam has a specific drive provided with a selflocking gear.

19. The loom as claimed in claim 17, characterized in that the warp thread tensioning device has a back bearer for the warp threads which is pretensioned by means of a tensioning spring device, the tensioning spring device being connected to the control device in such a way that the drives of the warp beam and of the cloth take-up be controlled in such a way that the predeterminable tension force can be maintained at the back bearer.

20. The loom as claimed in claim 19, characterized in that the tensioning spring device has a leaf spring with a flexion converter which is connected to the control device.

21. The loom as claimed in claim 19, characterized in that the tensioning spring device is connected to the back bearer via a safety device having an emergency switch which responds when the force of the warp threads which occurs at the back bearer is higher than the set tension force by a determinable safety amount.

* * * * *